US006290111B1

(12) United States Patent
Hedenberg et al.

(10) Patent No.: US 6,290,111 B1
(45) **Date of Patent: *Sep. 18, 2001**

(54) HARNESS

(75) Inventors: Håkan Hedenberg, Järfälla; John Grieves, Stockholm; Carl Göran Crafoord, Djursholm, all of (SE)

(73) Assignee: Interspiro AB (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/117,368

(22) PCT Filed: Feb. 11, 1997

(86) PCT No.: PCT/SE97/00202

§ 371 Date: Dec. 18, 1998

§ 102(e) Date: Dec. 18, 1998

(87) PCT Pub. No.: WO97/30609

PCT Pub. Date: Aug. 28, 1997

(30) Foreign Application Priority Data

Feb. 21, 1996 (SE) ..... 9600637

(51) Int. Cl.[7] ..... A45F 3/08
(52) U.S. Cl. ..... 224/262; 224/632; 224/634
(58) Field of Search ..... 224/631, 632, 224/634, 637, 261, 262

(56) References Cited

U.S. PATENT DOCUMENTS

| | | | | |
|---|---|---|---|---|
| 3,899,109 | * | 8/1975 | Noice | 224/262 |
| 4,114,788 | * | 9/1978 | Zufich | 224/262 |
| 4,660,751 | | 4/1987 | von Dewitz | 224/210 |
| 4,676,418 | | 6/1987 | Lowe | 224/215 |
| 5,553,759 | * | 9/1996 | McMaster et al. | 224/261 |
| 5,806,741 | * | 9/1998 | Kirk | 224/634 |
| 5,947,351 | * | 9/1999 | Garofalo et al. | 224/261 |
| 5,984,157 | * | 11/1999 | Swetish | 224/631 |

FOREIGN PATENT DOCUMENTS

| | | |
|---|---|---|
| 2 223 930 A | 4/1990 | (GB) . |
| 57445 | 1/1937 | (NO) . |

* cited by examiner

*Primary Examiner*—Stephen P. Garbe
(74) *Attorney, Agent, or Firm*—Connolly Bove Lodge & Hutz LLP

(57) ABSTRACT

A harness for holding and supporting at least one gas pressure-container. The harness includes a backplate, a container holder mounted on a first side of the backplate, and two elongated support straps disposed on respective sides of a symmetry line dividing the backplate into a left and a right part. A first end of the respective elongated support straps is attached to an upper part of the backplate. The harness further includes a waist belt fastened to a lower part of the backplate. Mounted on a lower part of a second side of the backplate is a first element which is at least substantially rigid and parallel with the backplate, and which is pivotably mounted on the backplate at a pivot point. Each of second ends of the elongated support straps is attached to the first element on a respective side of the pivot point.

14 Claims, 4 Drawing Sheets

HARNESS

BACKGROUND OF THE INVENTION

The present invention relates to a harness for holding and supporting at least one pressurized gas-container. The harness includes a backplate, container-holding means mounted on a first side of the backplate, two elongated support means arranged on respective sides of a symmetry line that divides the backplate into a left and a right part, wherein a first end of the support means is fastened to the upper part of the backplate and the opposite, second end of the support means is fastened to the lower part of the backplate, the harness further comprising a waist belt which is fastened to the lower part of the backplate.

A carrier harness of this kind is intended particularly for firemen, although it can also be used by underwater divers.

Harnesses of this kind will normally include a stiff or rigid backplate that is provided on its lower end (when fitted upright on a person) with a holder for holding at least one gas container that contains pressurized breathing gas. As shown in FIG. 5, the harness will normally include a strap so that functions to hold the gas container, i.e. typically a gas bottle or gas cylinder, tightly against the backplate and that embraces the gas container on a level with the upper part of the backplate, or some other means that functions to hold the gas bottle against the backplate.

A harness for retaining and/or transporting various articles is disclosed in U.S. Pat. No. 4 676 418. This harness comprises:

a framework or back plate on which a storage portion is mounted, shoulder straps for looping around the shoulders of the wearer and connected to the back plate, a waist plate mounted on the back plate for pivotal movement in a plane generally parallel to the wearer's back so as to be pivotably laterally with respect to the wearer, and a waist belt, secured to the waist plate, for fastening around the waist of the wearer to hold the waist plate in position. Further means for restricting the pivotal movement of the waist plate are described.

Further, from Norwegian patent specification No. 57 445 another harness is known. This harness comprises:

a framework or back plate on which a storage portion is mounted, a shoulder plate mounted on the back plate for pivotal movement in a plane generally parallel to the wearer's back so as to be pivotably laterally with respect to the wearer, shoulder straps mounted on the ends of the shoulder plate for looping around the shoulders of the wearer and connected to the back plate.

One object of the present invention is to provide a harness that is more flexible and that will be felt to be more comfortable by the user than hitherto known harnesses.

Another object of the invention is to provide a harness that will adapt to user body movements more readily and effectively than known harnesses of this kind.

The present invention thus relates to a harness for supporting a breathing gas pressure-container and comprising a backplate, means provided on a first side of the backplate for holding and supporting at least one, although often two, gas-filled pressure containers, two upper support straps on the second side of the backplate, wherein first ends of said straps are fastened to the upper part of the backplate in spaced relationship with one another, two lower support straps, wherein first ends of said straps are fastened to the lower part of the backplate in spaced relationship with one another, means for pair-wise connecting an upper and a lower support strap, and a waist belt which is fastened to the lower part of the backplate. The inventive harness is mainly characterized in that it includes on the lower part of the second side of the backplate an at least substantially rigid first element that extends parallel with the backplate and that is pivotably mounted on the backplate at a first pivot point, wherein each of the second ends of the elongated support means is fastened to the first element on a respective side of the pivot point.

It is particularly preferred that the first pivot point lies on the symmetry line. The first element will advantageously have the form of an elongated plate-like element whose end parts can be swung about a respective pivot line symmetrically with respect to the pivot point and parallel with and at a distance from the symmetry line, i.e. those parts of the element that lie outside the pivot line, i.e. at a greater distance from the symmetry line, can be pivoted forwardly of the backplate, wherein the elongated support means are attached to the element parts that can swing relative to the backplate.

According to another preferred embodiment, the waist belt is pivotably mounted on the second side of the backplate on a second pivot point.

According to a further preferred embodiment of the invention, the waist belt includes an at least substantially rigid second element that extends parallel to the backplate, and two flexible strap parts whose respective ends are connected to the second element, wherein the second element is pivotably mounted on the backplate on the second pivot point.

According to yet another preferred embodiment, the invention relates to a harness for carrying a pressurized breathing gas container, wherein the harness includes a backplate, means on a first side of the backplate for holding and supporting at least one, but often two gas-filled pressure containers, and two upper support straps on the other side of the backplate, wherein first ends of the support straps are fastened to the upper part of the backplate in mutually spaced relationship, two lower support straps, wherein first ends of the straps are fastened to the lower part of the backplate in mutually spaced relationship, means for mutually connecting an upper and a lower strap, and a waist belt that is fastened to the lower part of the backplate. The invention is mainly characterized in that the harness includes on the second side of the backplate, a third element which is at least substantially rigid and parallel with the backplate, wherein the third element is pivotably mounted on the backplate on a third pivot point on the symmetry line, and wherein each of the first ends of the elongated support means is fastened to the third element on a respective side of the pivot point.

BRIEF DESCRIPTION OF THE DRAWINGS

Further embodiments of the invention will be evident from the following detailed description of exemplifying embodiments thereof, made with reference to the accompanying drawings, in which.

DETAILED DESCRIPTION OF THE PREFERRED EMBODIMENTS

Figure 1:
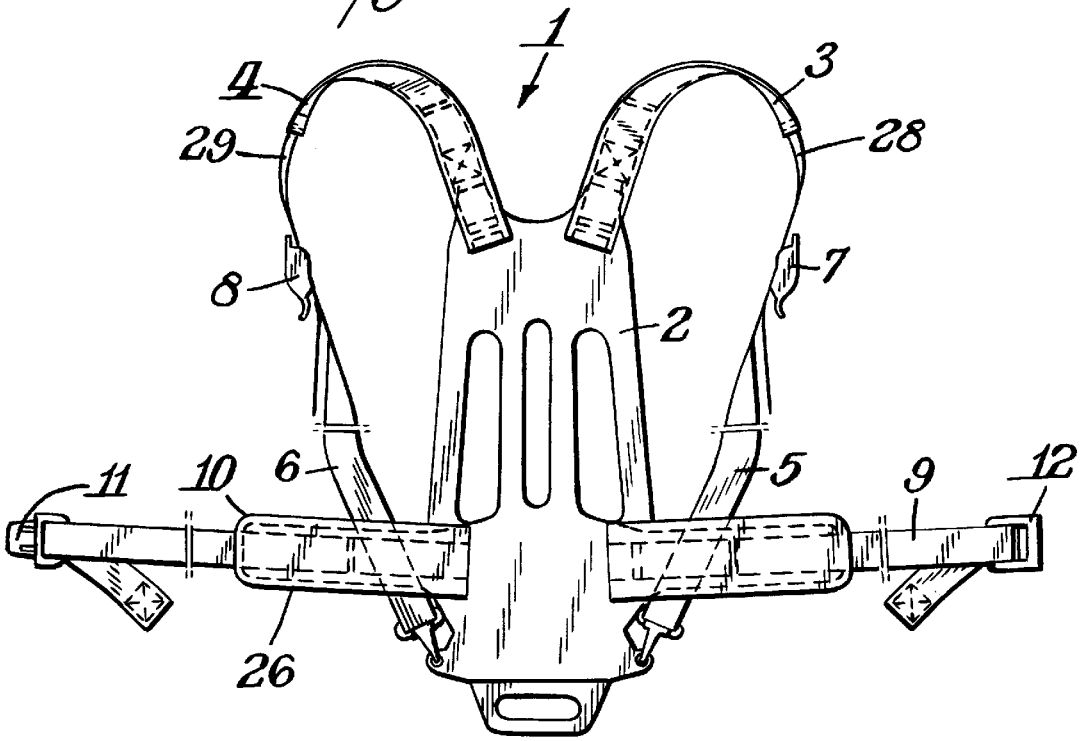
Fig. 1 Prior Art
FIG. 1 is a schematic front view of an earlier known harness.

FIG. 1 is a front view of a typical harness 1, comprising a rigid backplate 2.

When the harness 1 is in use, i.e. worn by a person who stands upright, the illustrated side of the backplate 2 will be in contact with the wearer's back. Provided on the opposite side of the backplate 2, in the lower part thereof, is a device (not shown) that functions to support one or two breathing-gas pressure containers. Although not shown, the upper half of the backplate 2 will have connected thereto a strap that embraces the container, i.e. the gas cylinder, and holds the container fixed against the backplate 2.

Two upper support straps 3, 4 are fastened to the upper part of the backplate 2 in mutual spaced relationship. Two lower support straps 5, 6 are fastened to the lower part of the backplate 2 in mutually spaced relationship. Those ends of the straps 3–6 that are not secured to the backplate 2 are joined in pairs by a respective buckle means 7, 8 that mutually connects respective straps 3, 5 and 4, 6. The straps 3, 5 and 4, 6 form respective support devices 28 and 29. The support devices 28 and 29 form, together with the backplate 2, closed loops whose size can be adjusted with the aid of the buckles 7, 8.

A waist belt 26 includes two belt sections 9, 10 and the ends of the belt are fastened to the lower part of the backplate 2 in mutual spaced relationship. The ends of the two waist-belt sections 9, 10 that lie distal from the backplate 2 can be joined together by means of a respective buckle part 11, 12, which enables the length of belt to be adjusted. The size of the loop formed by the waist-belt sections 9, 10 and the backplate 2 can be adjusted by means of the buckle 11, 12. The buckle 11, 12 is a part of the waist belt 26.

Figure 2:
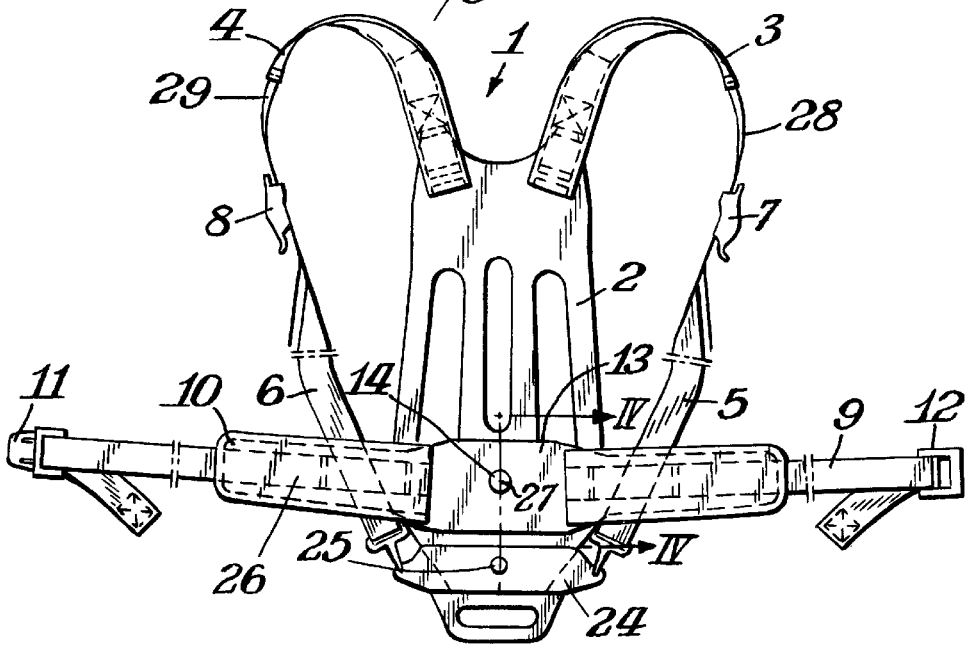
FIG. 2 is a schematic front view of a preferred embodiment of an inventive harness.

Those parts of an inventive harness 1 of a first embodiment of the invention that find correspondence in the afore-described known harness have been identified by the same references as those used above. In the FIG. 2 illustration, the two lower support straps 5, 6 are attached to a first plate-like element 24 which is pivotably mounted on the backplate 2 for pivotal movement about a first pivot point 25. Although the pivot point 25 will preferably lie in the lower part of the symmetry line 27 of the backplate 2, it may conceivably lie in the immediate vicinity of the symmetry line. The planar element 24 is pivotably mounted on the backplate 2 on the pivot point 25 by means, e.g., of a pivot shaft or pin that holds the element 24 against the backplate 2. This pivot shaft 25 extends perpendicular to the plane of the element 24 and the backplate 2.

Figure 3:
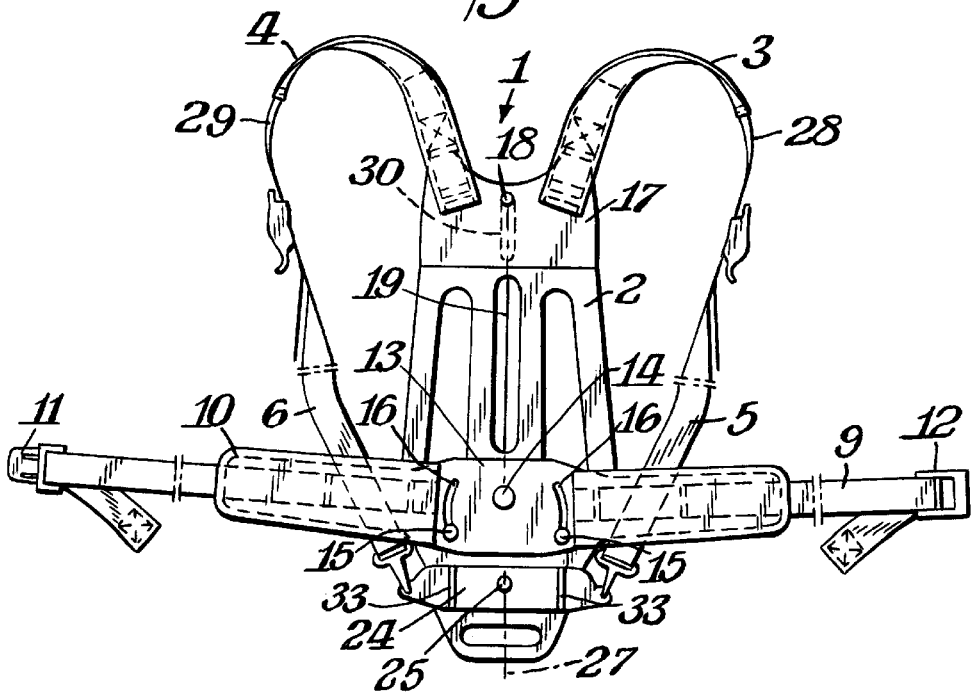
FIG. 3 is a schematic front view of another preferred embodiment of an inventive harness.
Figure 5:
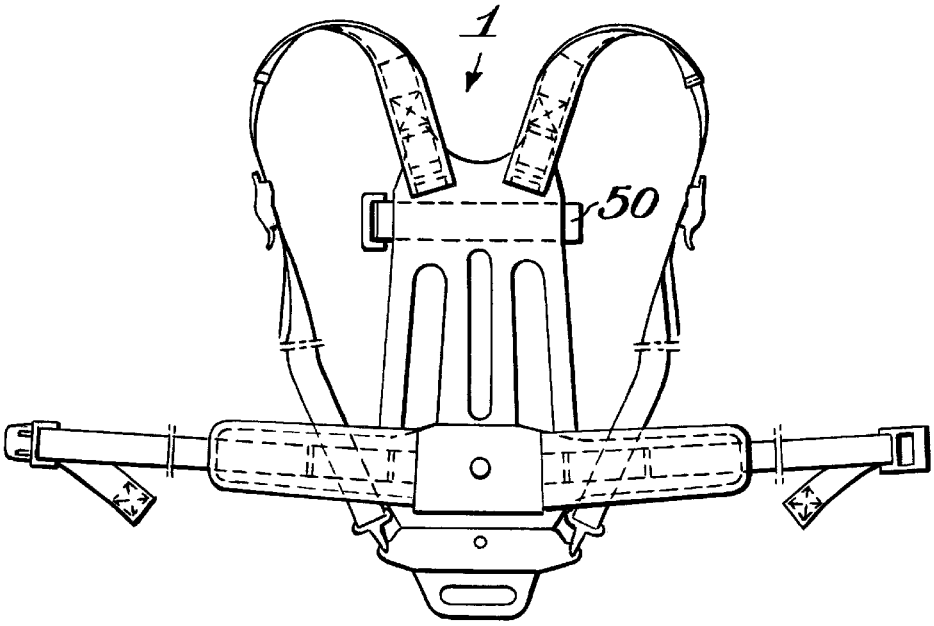
FIG. 5 show a strap for holding a gas-pressure container.

As illustrated in FIG. 3, the first element 24 is preferably an elongated plate-like element whose outer parts can pivot or swing toward and away from the symmetry line 27, symmetrically in spaced relationship with the pivot point 25. Hinge lines 33 that extend transversely to the long axis of the element 24, enable the outer ends of the element to fold forwards away from the backplate 2. The support devices 28, 29 are attached to these pivotal parts of the backplate 2.

As evident from FIG. 2, the waist-belt sections 9, 10 are attached to the outer ends of a plate-like second element 13 attached to the backplate 2. Similar to the planar first element 24, the planar second element 13 is pivotably mounted to the backplate 2 on a pivot point 14 that also functions to hold the element against the backplate 2, the pivot point having the form of a pivot shaft, for instance. The pivot shaft or pivot point 14 is disposed perpendicularly to the plane of the element 13 and the backplate 2. The waist belt 26 may alternatively be a one-piece structure that is pivotally connected to the backplate 2. The waist belt 26 may also be constructed in the manner shown in FIG. 1, i.e. attached to the backplate 2.

FIG. 3 illustrates a preferred embodiment in which the second element 13 includes two slots 16 that are spaced equidistantly from the pivot point 14, the slots coacting with respective pins 15 on the backplate 2. These slots 16 limit the extent to which the waist belt 26 can be swung around the pivot point 14. The pins 15 are preferably headed pins so as to hold the second element 13 more effectively against the backplate 2 and so as to obtain a more stable harness 1. Naturally, the slots 16 may be provided in the backplate 2 and the pins in the element 3.

The planar first element 24 may also conveniently be provided with movement-limiting devices corresponding to those that delimit movement of the second element 13. It is beneficial to enhance abutment of the element 24 with the backplate 2, therewith providing a more stable harness.

In the case of the FIG. 3 embodiment, the upper support straps 3, 4 are also attached to a third plate-like element 17. This third element may be rigidly disposed in the upper part of the backplate 2, or, as preferred, pivotably attached to the upper part of the plate 2 with the pivot point 18 on the symmetry line in the upper part of the backplate 2. It is also beneficial in this case to enhance abutment of the third element 17 with the backplate 2, with the aid of mutually coacting slots and pins, therewith improving stability of the harness.

The pivot shaft 18 on which the third element 17 pivots may alternatively be mounted in a gap 30 that extends along the symmetry line 27. The gap 30 is provided in the backplate 2. The third pivot point, the pivot shaft 18, is joined to the second pivot point 14 or to the lower part of the backplate 2 by means of an elastic or resilient device 19. This device functions to draw the third pivot point 18 towards the lower position of the gap. Alternatively, a gap may be provided in the third element 17, wherein the elastic or resilient device 19 connects the third element 17 to the second pivot point 14 or to the lower part of the backplate 2. Whichever alternative is used, it is essential that the element 17 is movable in relation to the second pivot point 14 or the lower part of the backplate 2.

Thus, the third element 17 of the inventive harness may either be rigidly connected to the backplate 2 or pivotably connected thereto, the upper support straps 3, 4 being connected to the third element. The pivotal arrangement may be such as to enable the third element to move in relation to respective first and second elements 24 and 13. The second element 13, which is a part of the waist-belt arrangement 9, 10, may be rigidly or pivotably mounted to the backplate 2.

Figure 4:
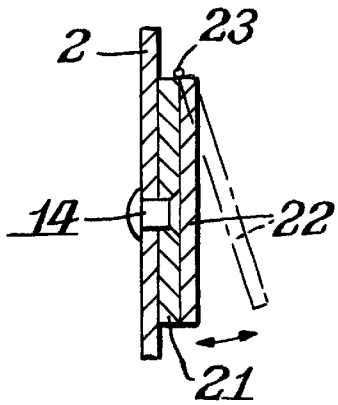
FIG. 4 is a schematic sectional view of part of the harness shown in FIG. 2, taken through the symmetry line.

According to one preferred embodiment (see FIG. 4), the second element 13 is comprised of two mutually parallel, flat plates 21 and 22 that lie one on top of the other. The first plate 21 may be fixed to the backplate 2 in the same way as the first element 24. The first plate 21 lies between the backplate 2 and the second plate 22. The two plates 21, 22 are mutually hinged at their upper ends, for instance by hinge means 23. The flexible parts of the waist-belt are connected to the second plate 22, in a manner similar to that of the first element 13 according to the previous embodiment.

As described with reference to element 13 of a previous embodiment, slots and pins may be provided in/on the first plate 21 outside the pivot point 14. Corresponding co-acting means may also be provided on the third element 17 and on the backplate 2.

In the case of a further embodiment, the pivot point 25 of the first element 24 lies beneath the pivot point 14 of the second element 13. The distance between the elements 24 and 13 is such as to enable said elements to be rotated freely without coming into contact with each other, even when the elements 24 and 13 move towards each other on one side of the symmetry line 27.

In the case of yet another embodiment, the pivot point 25 of the first element 24 lies above the pivot point 14 of the second element 13. The distance between the elements 24 and 13 is such as to enable said elements to be rotated without coming into contact with each other even when said elements move towards each other on one side of the symmetry line 27.

Figure 6:
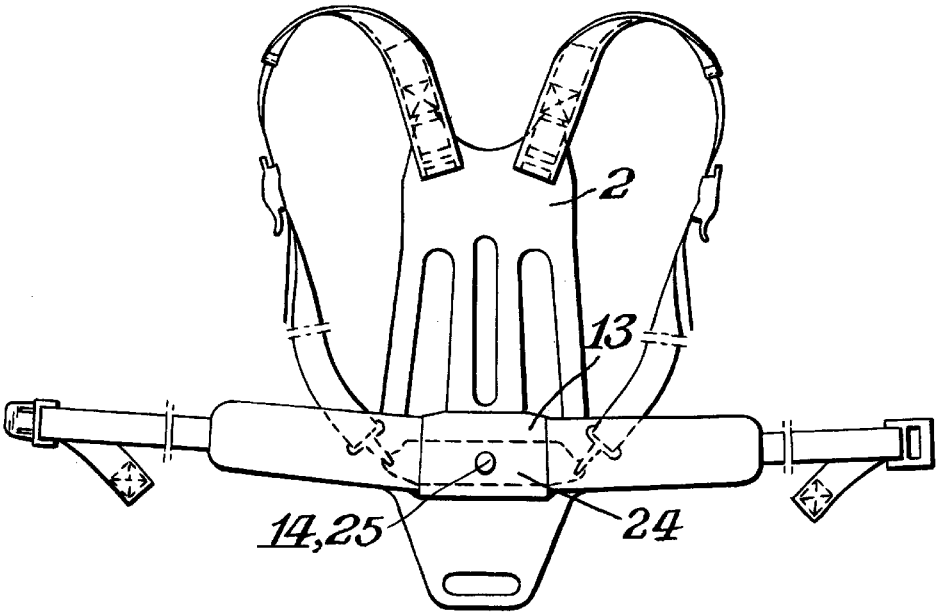
FIG. 6–7 show alternative embodiments of the harness.
Figure 7:
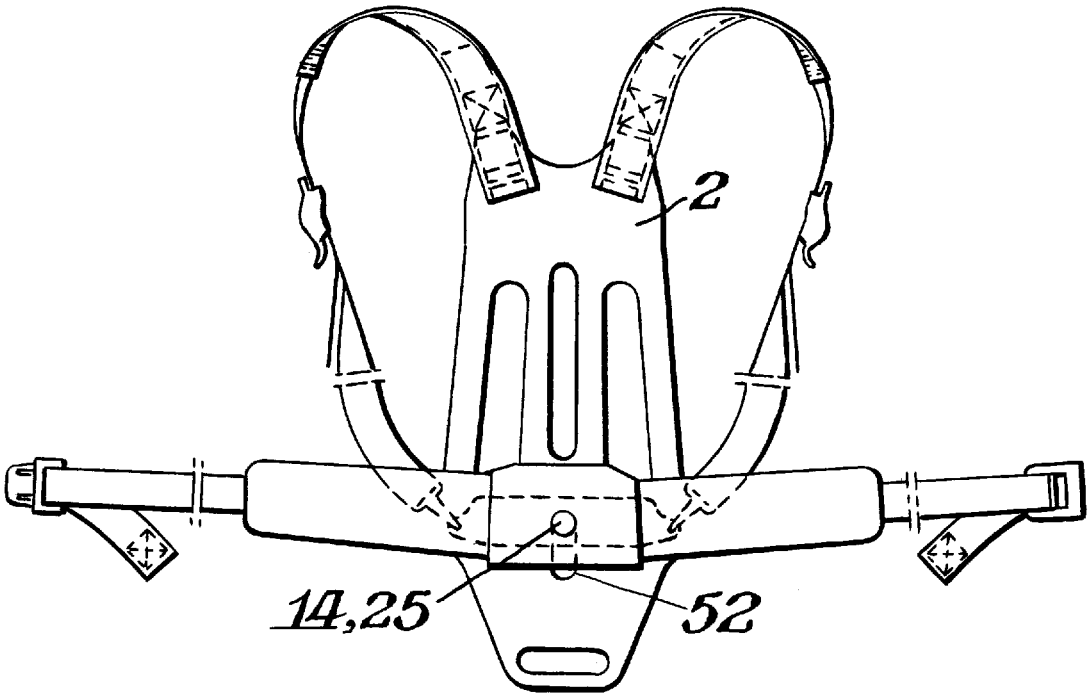

In one particularly preferred embodiment shown in FIG. 6, the first and the second pivot points 25, 14 are mutually coincidental and thus seated on a common pivot shaft. In this case, it is preferred that the first element 24 is located between the backplate 2 and the second element 13. The common pivot shaft 25, 14 may also be mounted in a gap 52 in the backplate 2, as shown in FIG. 7, and connected to one end of an elastic or resilient element 19 whose other end is attached to the upper part of the backplate 2 or to the pivot shaft 18. The gaps may, of course, alternatively be provided in the elements 13 and 14 instead of the backplate 2, the main thing being that the relative movement can be achieved.

What is claimed is:

1. A harness including a backplate, two elongated support means disposed on respective sides of a symmetry line that divides the backplate into a left and a right part, wherein a first end of respective elongated support means is attached to an upper part of the backplate, and wherein the harness further includes a waist belt fastened to a lower part of the backplate, wherein mounted on a lower part of a side of the backplate is a first element which is at least substantially rigid and parallel with the backplate and which is pivotably mounted on the backplate by means of a first pivot point, wherein each of second ends of the elongated support means is attached to the first element on a respective side of the pivot point.

2. A harness according to claim 1, wherein the first pivot point lies on the symmetry line.

3. A harness according to claim 1 wherein the first element is an elongated plate-like element that includes hinge lines that extend parallel with said symmetry line in spaced relationship with the pivot point, so as to enable foldable parts of the first element that are located outside respective hinge lines to be folded or swung forwardly away from the backplate; and wherein the elongated support means are fastened to said foldable parts of said first element.

4. A harness according to claim 1 wherein the waist belt is pivotably mounted on a second pivot on said side of the backplate.

5. A harness according to claim 4, wherein the waist belt includes an at least substantially rigid second element that extends parallel with the backplate, and two flexible strap-parts that are connected at one end to the second element, wherein the second element is pivotably mounted on said backplate at said second pivot point.

6. A harness according to claim 5, wherein the second element includes means that coact with the backplate so as to limit rotational movement of the waist belt.

7. A harness according to claim 5 wherein the second pivot point coincides with the first pivot point; and wherein the first element is located between the backplate and the second element.

8. A harness according to claim 7, wherein the common first and second pivot point is located in a vertical gap; and in that an elastic or resilient device connects the common pivot point with the upper part of the backplate so as to draw the common pivot point towards the upper position of said gap.

9. A harness according claim 5 wherein the first pivot point is located above the second pivot point.

10. A harness according to claim 5 wherein the first pivot point is located beneath the second pivot point.

11. A harness according to claim 7 wherein the second element includes two mutually parallel and at least substantially rigid plates that are hinged together along respective upper edges of the plates that extend parallel with the longitudinal direction of the waist belt; and wherein the first plate is pivotably mounted in the second pivot point.

12. A harness according to claim 1 wherein the first ends of the elongated support means are fastened in mutually spaced relationship to an at least substantially rigid third element; and wherein the third element is pivotably mounted on the upper part of the backplate on a third pivot that lies on the symmetry line.

13. A harness according to claim 12 wherein the third pivot point is located in a vertical gap; and in that an elastic or resilient device connects the third pivot point with the second pivot or the lower part of the backplate, therewith drawing the third pivot point towards the bottom position of the gap.

14. A harness comprising a backplate, an at least substantially rigid element parallel with the backplate and mounted thereon on a pivot point for pivotal movement parallel with the backplate, two elongated support means disposed on a respective side of a symmetry line that divides the backplate into a left and a right part, wherein a first end of a respective elongated support means is attached to the element on a respective side of the pivot point, wherein the pivot point is located in a vertical gap; and wherein said pivot point is joined to a lower part of the backplate by an elastic or resilient device which functions to draw the pivot point towards the lower position of said gap.

* * * * *

UNITED STATES PATENT AND TRADEMARK OFFICE

CERTIFICATE OF CORRECTION

PATENT NO. : 6,290,111 B1
DATED : September 18, 2001
INVENTOR(S) : Håkan Hedenberg, John Grieves, and Carl Göran Crafoord It is certified that error appears in the above-identified patent and that said Letters Patent is hereby corrected as shown below:

Column 1
Line 51, delete "felt to be".
Line 52, "by" should be deleted and replaced with -- to --.
Between lines 55 and 56, insert -- SUMMARY OF THE INVENTION --.
Line 61, "said" should be deleted and replaced with -- the --.
Line 64, "said" should be deleted and replaced with -- the --.

Signed and Sealed this

Twelfth Day of March, 2002

*Attest:*

*Attesting Officer*

JAMES E. ROGAN
*Director of the United States Patent and Trademark Office*